US011527210B2

(12) United States Patent
Jang et al.

(10) Patent No.: US 11,527,210 B2
(45) Date of Patent: Dec. 13, 2022

(54) METHOD OF SENSING CHARACTERISTIC VALUE OF CIRCUIT ELEMENT AND DISPLAY DEVICE USING IT

(71) Applicant: LG DISPLAY CO., LTD., Seoul (KR)

(72) Inventors: Seokyu Jang, Gyeonggi-do (KR); Seungbaek Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/343,143

(22) Filed: Jun. 9, 2021

(65) Prior Publication Data

US 2021/0407437 A1 Dec. 30, 2021

(30) Foreign Application Priority Data

Jun. 25, 2020 (KR) ..... 10-2020-0077692

(51) Int. Cl.
*G09G 3/3291* (2016.01)

(52) U.S. Cl.
CPC ... *G09G 3/3291* (2013.01); *G09G 2300/0833* (2013.01); *G09G 2310/0294* (2013.01); *G09G 2310/061* (2013.01)

(58) Field of Classification Search
CPC ..... G09G 3/3291
USPC ..... 345/204
See application file for complete search history.

(56) References Cited

U.S. PATENT DOCUMENTS

2015/0379937 A1* 12/2015 Kim ..... G09G 3/3275 345/691
2020/0152135 A1* 5/2020 Kang ..... G09G 3/3266

* cited by examiner

*Primary Examiner* — Long D Pham
(74) *Attorney, Agent, or Firm* — Morgan, Lewis & Bockius LLP

(57) ABSTRACT

The present disclosure generally relates to a method of sensing characteristic value of circuit element and display device using it, which may shorten the threshold voltage sensing and compensation time of the driving transistor and the threshold voltage compensation time driving transistors by sensing the threshold voltage in a mobility sensing period of the driving transistor, calculate the threshold voltage using two or more sensing values of driving current for the driving transistor.

12 Claims, 11 Drawing Sheets

METHOD OF SENSING CHARACTERISTIC VALUE OF CIRCUIT ELEMENT AND DISPLAY DEVICE USING IT

CROSS REFERENCE TO RELATED APPLICATION

This application claims priority to Korean Patent Application No. 10-2020-0077692, filed on Jun. 25, 2020, which is hereby incorporated by reference for all purposes as if fully set forth herein.

BACKGROUND

Technical Field

The present disclosure generally relates to a method of sensing a characteristic value of circuit element and display device using it.

Discussion of the Related Art

With the development of the information society, there has been an increasing demand for a variety of types of image display devices. In this regard, a range of display devices, such as liquid crystal display device, and organic light-emitting display device, have recently come into widespread use.

Among such display devices, organic light-emitting display devices have superior properties, such as rapid response speeds, high contrast ratios, high emissive efficiency, high luminance, and wide viewing angles, since self-emissive organic light-emitting diodes (OLEDs) are used.

Such an organic light-emitting display device may include organic light-emitting diodes disposed in a plurality of subpixels aligned in a display panel, and may control the organic light-emitting diodes to emit light by controlling a voltage flowing through the organic light-emitting diodes, so as to display an image while controlling luminance of the subpixels.

In such an organic light-emitting display device, an organic light-emitting diode and a driving transistor to drive organic light-emitting diode are disposed in each subpixel defined in the display panel. At this time, there may be deviations in the characteristics of transistors in each subpixel such as threshold voltage or mobility, due to changes over the driving time or by different driving times among the subpixels.

Accordingly, since luminance deviation (luminance non-uniformity) between subpixels may occur and image quality may be deteriorated, sensing and compensation technology may be used in order to solve the luminance deviation between subpixels.

In particular, characteristic values representing the characteristics of the driving transistor may include a threshold voltage and mobility. Since the threshold voltage is measured when the driving transistor reaches at saturation state, there is a disadvantage that it takes relatively a long time to compensate comparing the mobility.

SUMMARY

Accordingly, embodiments of the present disclosure are directed to a method of sensing characteristic value of circuit element and display device using it that substantially obviate one or more of the problems due to limitations and disadvantages of the related art.

An aspect of the present disclosure is to provide a method of sensing a characteristic value of circuit element and a display device using it able to shorten the threshold voltage sensing and compensation time of the driving transistor.

Another aspect is to provide a method of sensing a characteristic value of circuit element and a display device using it able to shorten the threshold voltage compensation time driving transistors by sensing the threshold voltage in a mobility sensing period of the driving transistor.

Another aspect is to provide a method of sensing a characteristic value of circuit element and a display device using it able to calculate the threshold voltage using two or more sensing values of driving current for the driving transistor.

To achieve these and other aspects of the inventive concepts, as embodied and broadly described, a display device may comprise a display panel including a plurality of gate lines, a plurality of data lines, and a plurality of subpixels, a gate driving circuit for driving the plurality of gate lines and a data driving circuit for driving the plurality of data lines and generating sensing voltages measured at different times during a blank period in a mobility sensing period of a driving transistor performed in real time during display driving.

The display device may further comprise a controller for controlling the gate driving circuit and the data driving circuit and calculating a threshold voltage of the driving transistor from the sensing voltage transmitted from the data driving circuit.

Each of the plurality of subpixels may comprises an organic light-emitting diode driven by the driving transistor, a switching transistor electrically connected between a gate node of the driving transistor and a data line among the plurality of data lines, a sensing transistor electrically connected between either a source node or a drain node of the driving transistor and a reference voltage line, and a storage capacitor electrically connected between the gate node of driving transistor and either a source node or a drain node of the switching transistor.

The mobility sensing period of the driving transistor may comprise an initializing period in which a data voltage-for-sensing is supplied to the subpixel to be sensed through the data line, and a reference voltage-for-sensing is supplied to the subpixel to be sensed through a reference voltage line, a tracking period in which the reference voltage-for-sensing is blocked by turning off the switching transistor and a voltage of the reference voltage line is increased, and a sampling period in which a current flowing through the reference voltage line is sensed.

The data driving circuit may comprise a sensing circuit of characteristic value for sensing a characteristic value of the driving transistor.

The sensing circuit of characteristic value may comprise an amplifier in which an inverting input terminal is electrically connected to a reference voltage line and a non-inverting input terminal is supplied with a reference voltage-for-comparing, a feedback capacitor electrically connected between the inverting input terminal and an output terminal of the amplifier, an initializing switch electrically connected to the feedback capacitor, and a sampling switch electrically connected to the output terminal of the amplifier.

The sensing voltages are voltages respectively measured in different blank periods.

The threshold voltage of the driving transistor is calculated by the following equation, $$Vth = \frac{Vdata1 - Vdata2 * \sqrt{\frac{\Delta V1}{\Delta V2}}}{1 - \sqrt{\frac{\Delta V1}{\Delta V2}}}$$

wherein Vdata1 is the data voltage applied at the first time, Vdata2 is the data voltage applied at the second time, and ΔV1 and ΔV2 are sensing voltages charged by the sensing circuit of characteristic value at the same time interval at the first time and the second time, respectively.

In another aspect, a method of sensing a characteristic value of a circuit element in a display panel comprises supplying a data voltage-for-sensing to a subpixel to be sensed through a data line, and supplying a reference voltage-for-sensing to the subpixel to be sensed through the reference voltage line, blocking the reference voltage-for-sensing and increasing a voltage of the reference voltage line in response to the reference voltage-for-sensing being blocked, sensing a driving current through the reference voltage line at different times, and calculating a threshold voltage of a driving transistor from a sensing voltage generated by the driving current.

According to one or more embodiments, it is possible to shorten the threshold voltage sensing and compensation time of the driving transistor.

According to one or more embodiments, it is possible to shorten the threshold voltage compensation time driving transistors by sensing the threshold voltage in a mobility sensing period of the driving transistor.

According to one or more embodiments, it is possible to calculate the threshold voltage using two or more sensing values of driving current for the driving transistor.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
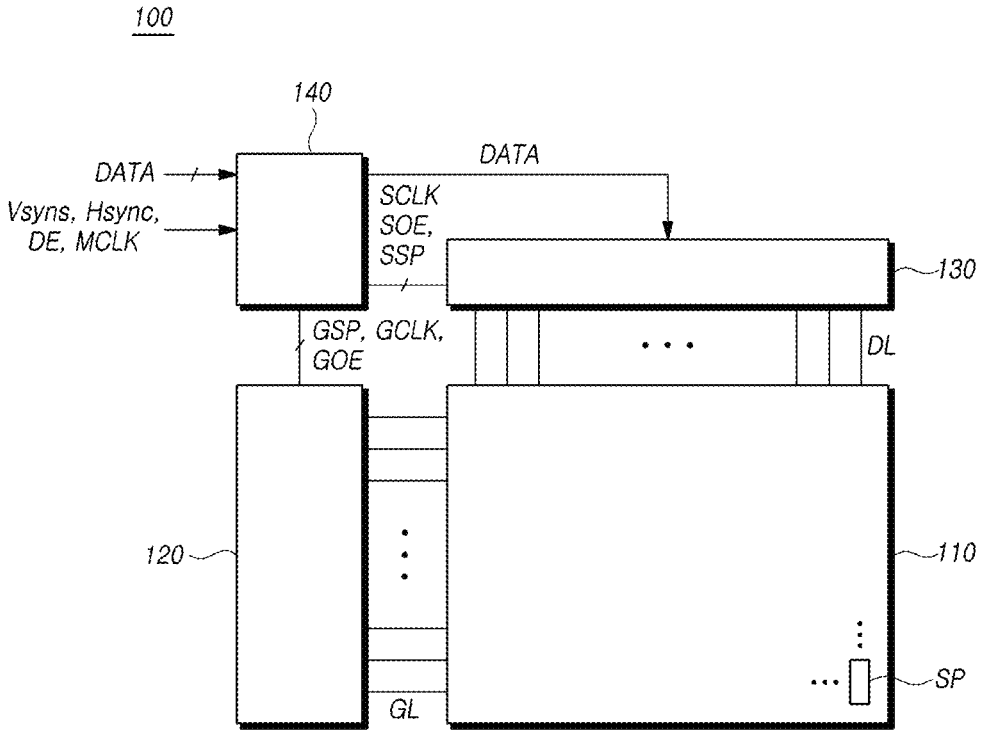
FIG. 1 illustrates a schematic diagram of a display device according to one or more embodiments.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 illustrates a schematic diagram of a display device according to one or more embodiments.

Referring to FIG. 1, the display device 100 according to one or more embodiments may include a display panel 110 in which a plurality of subpixels SP are aligned in rows and columns, a gate driving circuit 120 and a data driving circuit 130 for driving the display panel 110, and a controller 140 for controlling the gate driving circuit 120 and the data driving circuit 130.

The display panel 110 displays an image based on a scan signal transmitted from the gate driving circuit 120 through a plurality of gate lines GL and a data voltage transmitted from the data driving circuit 130 through a plurality of data lines DL.

In the case of a liquid crystal display, the display panel 110 includes a liquid crystal layer formed between two substrates, and TN (Twisted Nematic) mode, VA (Vertical Alignment) mode, IPS (In Plane Switching) mode, FFS (Fringe Field Switching) mode may be operated in any known mode. In the case of an organic light emitting display, the display panel 110 may be implemented in a top emission method, a bottom emission method, or a dual emission method.

In the display panel 110, a plurality of pixels may be disposed in a matrix form. Each pixel is a subpixel (SP) of a different color, for example, one or more or a white subpixel, a red subpixel, a green subpixel, and a blue subpixel. Each subpixel SP may be defined by the plurality of the data lines DL and the plurality of the gate lines GL.

One sub-pixel SP may include one of a thin film transistor (TFT) arranged in a region where one data line DL and one gate line GL intersect, and a light-emitting device such as an organic light emitting diode OLED charging the data voltage. One sub-pixel SP may include a storage capacitor for maintaining the data voltage by being electrically connected to the light-emitting device.

For example, when the display device 100 having a resolution of 2,160×3,840 includes four sub-pixels SP of white W, red R, green G, and blue B, 3,840×4=15,360 data lines DL may be provided by 2,160 gate lines GL and 3,840 data lines DL respectively connected to 4 sub-pixels WRGB. A plurality of subpixels SP may be aligned in adjacent areas in which the plurality of gate lines GL overlap the plurality of data lines DL.

The gate driving circuit 120 is controlled by the controller 140, and controls the driving timing of the plurality of subpixels SP by sequentially supplying scan signals SCAN to the plurality of gate lines GL disposed in the display panel 110.

In the display device 100 having a resolution of 2,160×3,840, sequentially supplying the scan signals to the 2,160 gate lines GL from the first gate line GL1 to the 2,160th gate line GL2,160 may be referred to as 2,160-phase driving. Otherwise, sequentially supplying the scan signals to every four gate lines, as in a case in which the scan signals are supplied sequentially from first gate line GL1 to fourth gate lines GL4, and then are supplied sequentially from fifth gate line GL5 to eighth gate line GL8, is referred to as 4-phase driving. As described above, a case in which the scan signals are supplied sequentially to every N number of gate lines may be referred as N-phase driving.

The gate driving circuit 120 may include one or more gate driver integrated circuits (GDIC), which may be disposed on one side or both sides of the display panel 110 depending on the driving method. Alternatively, the gate driving circuit 120 may be implemented in a gate-in-panel (GIP) structure embedded in a bezel area of the display panel 110.

The data driving circuit 130 receives image data DATA from the controller 140, and converts the received image data into an analog data voltage Vdata. Afterwards, the data driving circuit 130 supplies the data voltage Vdata to each of the data lines DL at points in time at which the scan signal is applied through the gate lines GL, so that each of the subpixels SP connected to the data lines DL emits light with a corresponding luminance in response to the data voltage Vdata.

Likewise, the data driving circuit 130 may include one or more source driver integrated circuits SDICs. Each of the source driver Integrated circuits SDICs may be connected to a bonding pad of the display panel 110 by a tape automated bonding (TAB) or a chip on glass (COG), or may be directly mounted on the display panel 110.

In some cases, each of the source driver integrated circuits SDIC may be integrated with the display panel 110. In addition, each of the source driver integrated circuits SDICs may be implemented with a chip on film (COF) structure. In this case, the source driver integrated circuit SDIC may be mounted on circuit films to be electrically connected to the data lines DL in the display panel 110 via the circuit films.

The controller 140 supplies various control signals to the gate driving circuit 120 and the data driving circuit 130, and controls the operations of the gate driving circuit 120 and the data driving circuit 130. That is, the controller 140 controls the gate driving circuit 120 to supply the scan signal SCAN in response to a time realized by respective frames, and on the other hand, converts data input from an external source into image data having a data signal format readable by the data driving circuit 130, and supplies the converted image data to the data driving circuit 130.

Here, the controller 140 receives various timing signals, including a vertical synchronization signal Vsync, a horizontal synchronization signal Hsync, a data enable signal DE, a clock signal CLK, and the like, from an external source (e.g., a host system). Accordingly, the controller 140 generates control signals using the various timing signals received from the external source, and supplies the control signals to the gate driving circuit 120 and the data driving circuit 130.

For example, the controller 140 supplies various gate control signals, including a gate start pulse GSP, a gate shift clock GSC, a gate output enable GOE, and the like, to control the gate driving circuit 120. Here, the gate start pulse GSP is used to control the start timing of one or more gate driver integrated circuits GDICs of the gate driving circuit 120. In addition, the gate shift clock GSC is a clock signal commonly supplied to the one or more gate driver integrated circuits GDICs to control the shift timing of the scan signal. The gate output enable GOE designates timing information of the one or more gate driver integrated circuits GDICs.

In addition, the controller 140 supplies various data control signals DCSs, including a source start pulse SSP signal, a source sampling clock SSC, a source output enable SOE, and the like, to control the data driving circuit 130. Here, the source start pulse SSP is used to control the start timing for the data sampling of one or more source driver integrated circuits SDICs of the data driving circuit 130. The source sampling clock SSC is a clock signal controlling the sampling timing of data in each of the source driver integrated circuits SDICs. The source output enable SOE controls the output timing of the data driving circuit 130.

The display device 100 may further include a power management integrated circuit PMIC supplying various forms of voltage or current to the display panel 110, the gate driving circuit 120, the data driving circuit 130, and the like, or controlling various forms of voltage or current to be supplied to the same.

The subpixels SP are located adjacent to points at which the gate lines GL overlap with the data lines DL, and a light-emitting element may be disposed in each of the subpixels SP. For example, the organic light-emitting display device 100 includes a light-emitting element, such as a light-emitting diode (LED) or an organic light-emitting diode (OLED) in each of the subpixels SP, and may display an image by controlling current flowing through the light-emitting elements in response to the data voltage Vdata.

The display device 100 may be various types of devices such as a liquid crystal display, an organic light emitting display, and a plasma display panel.

Figure 2:
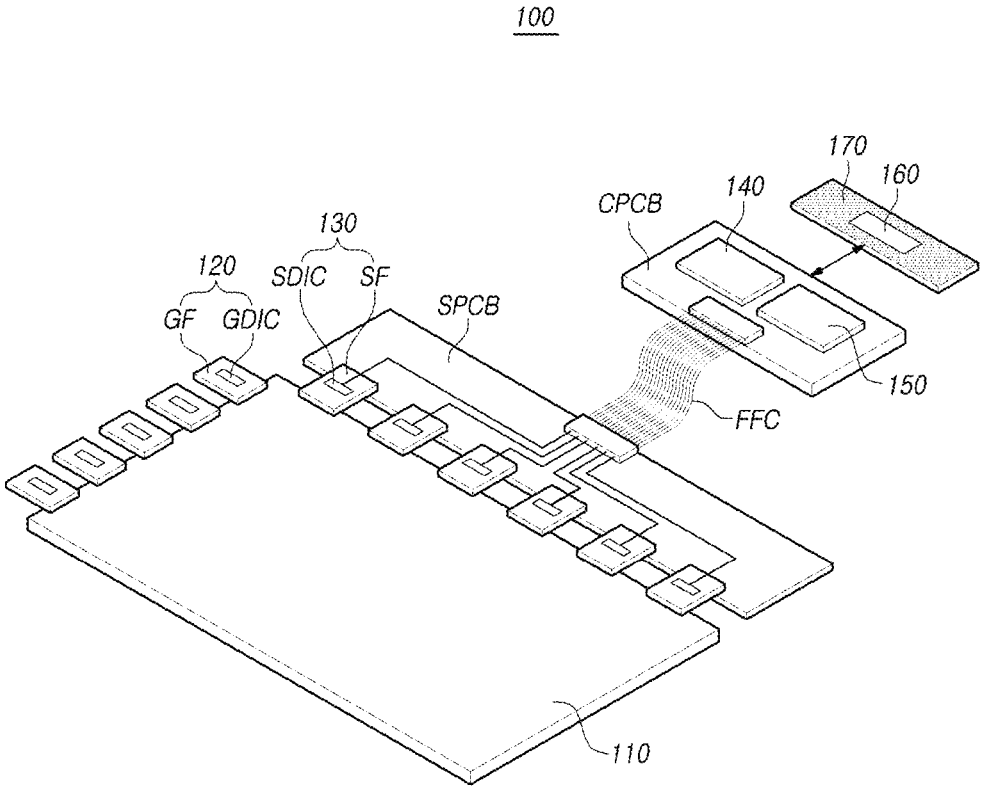
FIG. 2 illustrates a system of the display device according to one or more embodiments.

FIG. 2 illustrates a system of the display device according to one or more embodiments.

In the display device 100 illustrated in FIG. 2, each of the source driver integrated circuits SDICs of the data driving circuit 130 is implemented with a COF among various structures, such as a TAB, a COG, and a COF, and the gate driving circuit 120 is implemented with a GIP among various structures, such as a TAB, a COG, a COF, and a GIP.

The gate driving circuit 120 may include one or more gate driver integrated circuits GDICs, which mounted on a gate-side circuit films SF, respectively. One portion of the gate-side circuit film SF may be electrically connected to the display panel 110. In addition, electrical lines may be disposed in the top portion of the gate-side circuit films SF to electrically connect the gate driver integrated circuits GDICs and the display panel 110.

The gate driving circuit 120 may include one or more source driver integrated circuits SDICs, which may be mounted on a source-side circuit films SF, respectively. One portion of the source-side circuit film SF may be electrically connected to the display panel 110. In addition, electrical lines may be disposed in the top portion of the source-side circuit films SF to electrically connect the source driver integrated circuits SDICs and the display panel 110.

The display device 100 may include at least one source printed circuit board SPCB in order to connect the plurality of source driver integrated circuits SDICs to other devices by electrical circuit, and a control printed circuit board CPCB in order to mount various control components and electric devices.

The other portion of the source-side circuit film SF, on which the source driver integrated circuit SDIC is mounted, may be connected to the at least one source printed circuit board SPCB. That is, one portion of source-side circuit film SF, on which the source driver integrated circuit SDIC is mounted, may be electrically connected to the display panel 110, and the other portion of the source-side circuit film SF may be electrically connected to the source printed circuit board SPCB.

The controller 140 and a power management integrated circuit PMIC 150 may be mounted on the control printed circuit board CPCB. The controller 140 may control the operations of the data driving circuit 130 and the gate driving circuit 120. The power management integrated circuit PMIC 150 may supply various forms of voltage or current including a driving voltage, to the data driving circuit 130, the gate driving circuit 120, and the like, or may control the voltage or current to be supplied to the same.

At least one source printed circuit board SPCB and the control printed circuit board CPCB may have circuitry connection by at least one connecting member. The connecting member may be, for example, a flexible printed circuit FPC, a flexible flat cable FFC, or the like. At least one source printed circuit board SPCB and the control printed circuit board CPCB may be integrated into a single printed circuit board.

The display device 100 may further include a set board 170 electrically connected to the control printed circuit board CPCB. The set board 170 may also be referred to as a power board. A main power management circuit M-PMC 160 managing overall power of the display device 100 may be located on the set board 170. The main power management circuit M-PMC 160 may be coupled to the power management integrated circuit PMIC 150.

In the display device 100 having the above-described configuration, a driving voltage EVDD is generated by the set board 170 to be transferred to the power management integrated circuit 150. The power management integrated circuit 150 transfers the driving voltage EVDD, which is used during an image driving period or a sensing period, to the source printed circuit board SPCB through a flexible printed circuit FPC or a flexible flat cable FFC. The driving voltage EVDD, transferred to the source printed circuit board SPCB, is supplied to emit or sense a specific subpixel SP in the display panel 110 via the source driver integrated circuits SDICs.

Each of the subpixels SP aligned in the display panel 110 of the display device 100 may include a light-emitting element, such as an organic light-emitting diode (OLED), and circuit elements, such as a driving transistor to drive it.

The type and number of circuit elements forming each of the subpixels SP may be variously determined depending on the function, the design, or the like.

Figure 3:
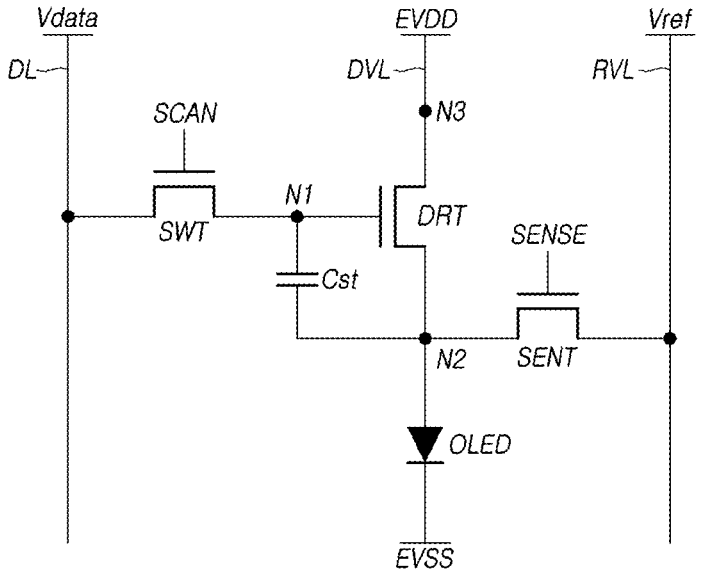
FIG. 3 illustrates a circuit structure of subpixels aligned in the display device according to one or more embodiments.

FIG. 3 illustrates a circuit structure of subpixels aligned in the display device according to one or more embodiments.

Referring to FIG. 3, each of the subpixels SP aligned in the display device 100 according to one or more embodiments may include one or more transistors, a capacitor, and an organic light-emitting diode OLED as a light-emitting element.

For example, the subpixel SP may include a driving transistor DRT, a switching transistor SWT, a sensing transistor SENT, a storage capacitor Cst, and the organic light-emitting diode OLED.

The driving transistor DRT may have a first node N1, a second node N2, and a third node N3. The first node N1 of the driving transistor DRT may be a gate node to supply a data voltage Vdata through a data line DL when the switching transistor SWT is turned on. The second node N2 of the driving transistor DRT may be electrically connected to an anode of the organic light-emitting diode OLED, and may be a drain node or a source node. The third node N3 of the driving transistor DRT may be electrically connected to a driving voltage line DVL in which a driving voltage EVDD is supplied, and may be a source node or a drain node.

Here, the driving voltage EVDD for the image driving may be supplied to the driving voltage line DVL in the image driving period. For example, the driving voltage EVDD for the image driving may be about 27V.

The switching transistor SWT is electrically connected between the first node N1 of the driving transistor DRT and the data line DL, and operates in response to the scan signal SCAN supplied thereto through the gate line GL connected to the gate node. In addition, it controls the operation of the driving transistor DRT by supplying the data voltage Vdata from the data line DL to the gate node of the driving transistor DRT when the switching transistor SWT is turned on.

The sensing transistor SENT is electrically connected between the second node of the driving transistor DRT and a reference voltage line RVL, and operates in response to the scan signal SCAN supplied thereto through the gate line GL connected to the gate node. When the sensing transistor SENT is turned on, a reference voltage-for-sensing Vref from the reference voltage line RVL is supplied to the second node N2 of the driving transistor DRT.

That is, the voltages of the first node N1 and the second node N2 of the driving transistor DRT may be controlled by controlling the switching transistor SWT and the sensing transistor SENT. Consequently, a current for driving the organic light-emitting diode OLED can be supplied.

The switching transistor SWT and the sensing transistor SENT may be connected to a single gate line GL or to different signal lines. Here, it illustrates an exemplary structure of which the switching transistor SWT and the sensing transistor SENT are connected to a single gate line GL. In this case, the switching transistor SWT and the sensing transistor SENT are controlled independently by the scan signal SCAN from the single gate line GL.

When the switching transistor SWT and the sensing transistor SENT may be connected to a single gate line GL, the switching transistor SWT and the sensing transistor SENT are controlled simultaneously by the scan signal SCAN or a sense signal SENSE from the single gate line GL, and thus the aperture ratio of the subpixels SP may be improved.

In addition, the transistors disposed in the subpixels SP may be not only n-type transistors, but also p-type transistors. Herein, it illustrates the exemplary structure of the n-type transistors.

The storage capacitor Cst is electrically connected between the first node N1 and the second node N2 of the driving transistor DRT, and serves to maintain the data voltage Vdata for one frame period.

Such a storage capacitor Cst may be connected between the first node N1 and the third node N3 of the driving transistor DRT depending on the type of the driving transistor DRT. The anode of the organic light-emitting diode OLED may be electrically connected to the second node N2 of the driving transistor DRT, and a base voltage EVSS may be supplied to a cathode of the organic light-emitting diode OLED.

Here, the base voltage EVSS may be the ground voltage or a voltage higher or lower than the ground voltage. In addition, the base voltage EVSS may vary depending on the driving condition. For example, the base voltage EVSS during the image driving period may be different from the base voltage EVSS during the sensing period.

The structure of the subpixel SP as described above has three transistors and one capacitor 3T1C. However, this is merely for illustrative purposes, and one or more transistors, or in some cases, one or more capacitors may be further included. In addition, the plurality of subpixels SP may have the same structure, or some of the plurality of subpixels SP may have a different structure from the other subpixels.

The display device 100 according to one or more embodiments may use a method for measuring a current flowing by voltage charged in the storage capacitor Cst during a sensing period for the driving transistor DRT in order to sense the characteristics of the driving transistor DRT like threshold voltage or mobility. Such a method may be referred to as current sensing.

That is, the characteristic value or the change of the characteristic value of the driving transistor DRT in the subpixel SP may be determined by measuring the current flowing by voltage charged in the storage capacitor Cst during the sensing period of the driving transistor DRT.

At this time, the reference voltage line RVL may be referred to as a sensing line since the reference voltage line RVL serves not only to supply the reference voltage Vref but also serves as a sensing line for sensing the characteristic value of the driving transistor DRT in the subpixel SP.

More specifically, in the display device 100 according to one or more embodiments, the characteristic value or the change of the characteristic value of the driving transistor DRT may correspond to a difference (e.g., Vdata−Vref) between the voltage of the first node N1 and the voltage of the second node N2 of the driving transistor DRT.

The sensing for the characteristic value of the driving transistor DRT may be performed by, for example, a sensing circuit of characteristic value included in the data driving circuit 130.

Figure 4:
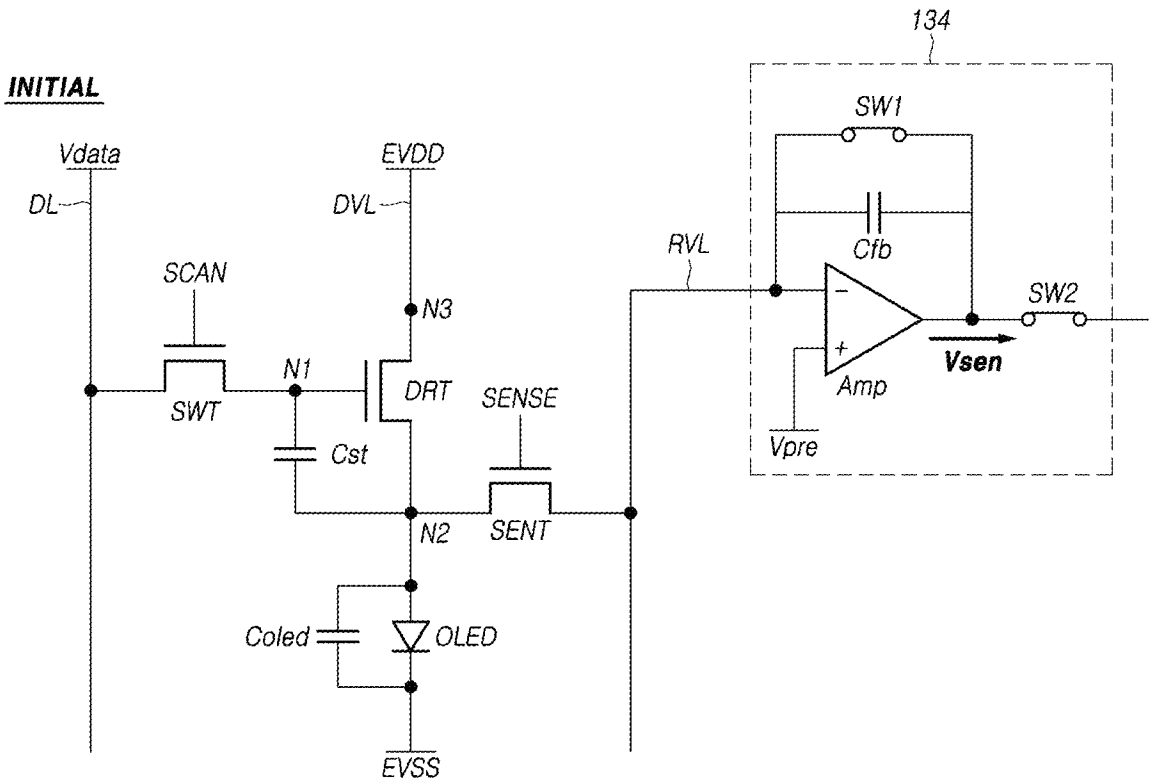
FIG. 4 illustrates a sensing circuit of characteristic value for sensing characteristics of driving transistors in the display device according to one or more embodiments.

FIG. 4 illustrates a sensing circuit of characteristic value for sensing characteristics of driving transistors in the display device according to one or more embodiments.

Referring to FIG. 4, in the display 100 device according to one or more embodiments, the data driving circuit 130 may supply the data voltage Vdata at the level of the data voltage-for-sensing Vdata_sen through the data line DL in a period for sensing the characteristic value of the driving transistor DRT, and supply the reference voltage-for-sensing Vref through the reference voltage line RVL. At this time, the data voltage-for-sensing Vdata_sen supplied through the data line DL may be about 14V, and the reference voltage-for-sensing Vref supplied through the reference voltage line RVL may be about 4V.

As a result, due to a voltage difference formed between the first node N1 and the second node N2 of the driving transistor DRT, the storage capacitor Cst can be charged.

At this time, the driving voltage EVDD supplied through the driving voltage line DVL during the sensing period for the characteristic value of the driving transistor DRT may be equal to or lower than the driving voltage supplied during the image driving period of the display panel.

The sensing circuit 134 of characteristic value included in the data driver 130 senses the capacitance charged in the storage capacitor Cst of the driving transistor DRT and supplies a sensing voltage Vsen according to the sensed capacitance.

The supplied sensing voltage Vsen may be transmitted to the controller 140 and the controller 140 determines the characteristic value or the change of the characteristic value of the driving transistor DRT from the sensing voltage Vsen.

When there is a change in the characteristic value of the driving transistor DRT, the controller 140 supplies the compensated data voltage Vdata to the corresponding subpixel SP according to a size of the change. As a result, the subpixel SP may emit the light with luminance corresponding to the compensated data voltage Vdata, thereby reducing luminance non-uniformity.

The sensing circuit 134 of characteristic value may have various structures, for example, a feedback capacitor Cfb and an amplifier. In this case, it may include an initializing switch SW1 for initializing the feedback capacitor Cfb and a sampling switch SW2 for sampling the sensing voltage Vsen.

In the amplifier, the reference voltage-for-comparing Vpre may be applied to the non-inverting input terminal (+), and the inverting input terminal (−) may be connected to the reference voltage line RVL. The feedback capacitor Cfb and the initializing switch SW1 may be electrically connected between the inverting input terminal (−) and the output terminal of the amplifier.

When the feedback capacitor Cfb is charged by the capacitance in the storage capacitor Cst of the driving transistor DRT, the change of capacitance charged in the storage capacitor Cst may be sensed in accordance with the change in the characteristic value of the driving transistor DRT.

At this time, since the amplifier generates a value in the negative direction as the capacitance charged in the feedback capacitor Cfb increases, the sensing voltage Vsen may be increased by decreasing of the capacitance charged in the storage capacitor Cst due to a change in the characteristic value of the driving transistor DRT.

Meanwhile, the display device 100 according to the one or more embodiments may include a memory stored with a reference sensing voltage in advance, and a compensator for compensating the deviation of the characteristic value by comparing the reference sensing voltage stored in the memory with the sensing voltage measured in the sensing circuit 134 of characteristic value.

The compensation value calculated by the compensator may be stored in the memory MEM and the controller 140 may change the image data to be supplied to the data driving circuit 130 using the compensation value calculated by the compensator, and supply the changed image data to the data driving circuit 130.

Accordingly, the data driving circuit 130 supplies the changed image data to the corresponding data line DL, so that the deviation of the characteristic value (e.g., the deviation of threshold voltage, the deviation of the mobility) for the driving transistor DRT in the corresponding subpixel SP may be compensated.

Figure 5:
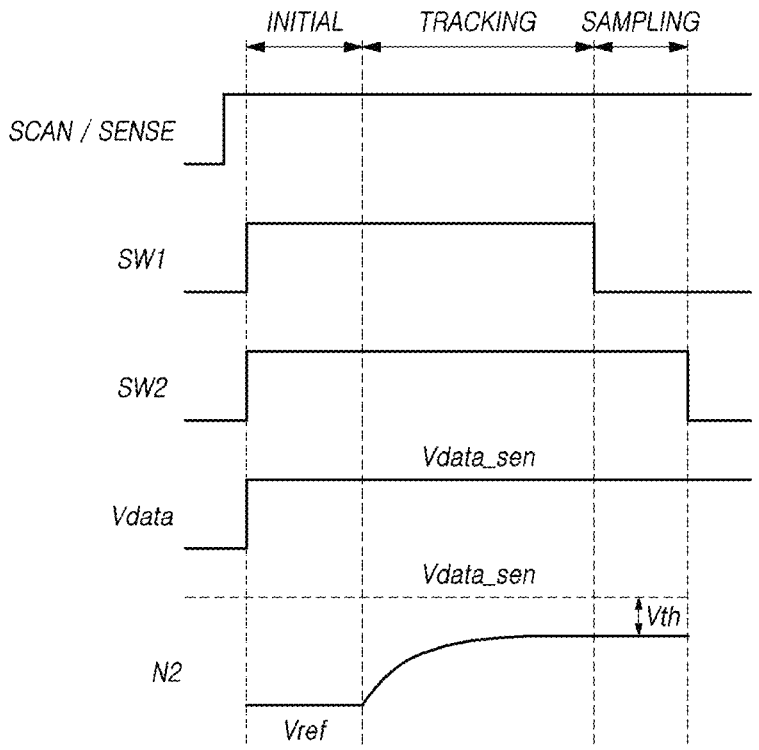
FIG. 5 illustrates a signal timing diagram for sensing threshold voltage of the driving transistor in the display device according to one or more embodiments.

FIG. 5 illustrates a signal timing diagram for sensing threshold voltage of the driving transistor in the display device according to one or more embodiments.

Referring to FIG. 5, the threshold voltage sensing process of the driving transistor DRT may be comprised of an initializing period INITIAL, a tracking period TRACKING, and a sampling period SAMPLING.

Since the switching transistor SWT and the sensing transistor SENT are generally turned on and turned off for sensing the threshold voltage of the driving transistor DRT, the scan signal SCAN and the sense signal SENSE may be applied simultaneously through one gate line GL.

The initializing period INITIAL is a period to charge the second node N2 of the driving transistor DRT with the reference voltage-for-sensing Vref for sensing the characteristic value of the driving transistor DRT, and the scan signal SCAN and the sense signal SENSE may be applied with a high level through the gate line GL.

The tracking period TRACKING is a period to charge the storage capacitor Cst after completing the charge for the second node N2 of the driving transistor DRT.

The sampling period SAMPLING is a period to detect the current flowing by the capacitance charged in the storage capacitor Cst via the sensing circuit 134 of characteristic value after the storage capacitor Cst of the driving transistor DRT is charged.

In the initializing period INITIAL, the switching transistor SWT is turned on by the scan signal SCAN/sense signal SENSE with turn-on level. As a result, the first node N1 of the driving transistor DRT is initialized to the data voltage-for-sensing Vdata_sen for sensing the threshold voltage.

In addition, the scan signal SCAN/sense signal SENSE with a turn-on level cause the sensing transistor SENT to be turned on. In this state, the second node N2 of the driving transistor DRT is initialized to the reference voltage-for-sensing Vref by the reference voltage-for-sensing Vref applied through the reference voltage line RVL.

The tracking period TRACKING is a period to track the threshold voltage of the driving transistor DRT. In the tracking period TRACKING, the voltage of the second node N2 of the driving transistor DRT which indicates the threshold voltage of the driving transistor DRT is tracked. In the tracking period TRACKING, the switching transistor SWT and the sensing transistor SENT are maintained to turn-on level and the reference voltage-for-sensing Vref applied through the reference voltage line RVL is blocked (e.g., the reference voltage-for-sensing Vref is no longer applied to the reference voltage line RVL).

Consequently, the second node N2 of the driving transistor DRT is floated, so that the voltage of the second node N2 of the driving transistor DRT is increased from the reference voltage-for-sensing Vref. At this time, since the sensing transistor SENT is turned on, the rise of the voltage at the second node N2 of the driving transistor DRT leads to the rise of the voltage at the reference voltage line RVL.

The feedback capacitor Cfb is not charged when the initializing switch SW1 of the sensing circuit 134 of characteristic value is turned on.

In this process, the voltage at the second node N2 of the driving transistor DRT rises and becomes a saturation state. The saturation voltage at the second node N2 of the driving transistor DRT corresponds to the difference (Vdata_sen−Vth) between the data voltage-for-sensing Vdata_sen for sensing the threshold voltage and the threshold voltage Vth of the driving transistor DRT.

In the sampling period SAMPLING, the scan signal SCAN/sense signal SENSE with a high level are applied to the gate line GL, the initializing switch SW1 of the sensing circuit 134 of characteristic value is turned off, and the sampling switch SW2 maintains the turn-on state. At this time, the capacitance charged in the storage capacitor Cst of the drive transistor DRT is supplied to the feedback capacitor Cfb of the sensing circuit 134 of characteristic value, since the initializing switch SW1 of the sensing circuit 134 of characteristic value is in the turn-off state.

The amplifier in the sensing circuit 134 of characteristic value generates the sensing voltage Vsen according to the capacitance charged in the feedback capacitor Cfb. The larger the capacitance charged in the feedback capacitor Cfb is, the further the sensing voltage Vsen goes forward to (−) direction. Therefore, when the capacitance charged in the storage capacitor Cst decreases due to the deterioration of the driving transistor DRT, the capacitance charged in the feedback capacitor Cfb decreases, and as a result, the amplifier generates a higher sensing voltage Vsen than before it deteriorated. The deterioration of the driving transistor DRT may be sensed by using the value of the sensing voltage Vsen supplied from the amplifier.

Figure 6:
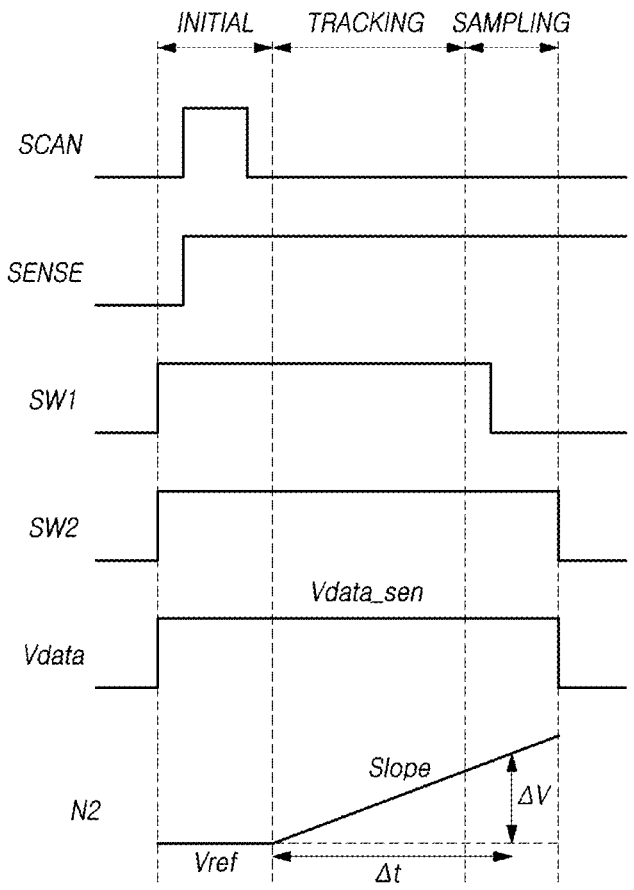
FIG. 6 illustrates a signal timing diagram for sensing the mobility of the driving transistor in the display device according to one or more embodiments.

FIG. 6 illustrates a signal timing diagram for sensing the mobility of the driving transistor in the display device according to one or more embodiments.

Referring to FIG. 6, the mobility sensing process of the driving transistor DRT in the display device 100 according to one or more embodiments may be comprised of an initializing period INITIAL, a tracking period TRACKING, and a sampling period SAMPLING like the threshold voltage sensing process.

In the initializing period INITIAL, the switching transistor SWT is turned on by scan signal SCAN with the turn-on level, and the first node N1 of the driving transistor DRT is initialized to the data voltage Vdata for sensing the mobility. In addition, a sense signal SENSE with a turn-on level causes the sensing transistor SENT to be turned on. In this state, the second node N2 of the driving transistor DRT is initialized to the reference voltage-for-sensing Vref.

The tracking period TRACKING is a period to track the mobility of the driving transistor DRT. The mobility of the driving transistor DRT may indicate current driving ability of the driving transistor DRT. In the tracking period TRACKING, the voltage at the second node N2 of the driving transistor DRT for determining the mobility of the driving transistor DRT is tracked.

In the tracking period TRACKING, the switching transistor SWT is turned off by the scan signal SCAN with a turn-off level, and a switch to receive the reference voltage-for-sensing Vref is blocked. Consequently, both the first node N1 and the second node N2 of the driving transistor DRT are floated, so that both the voltage at the first node N1 and the voltage at the second node N2 of the driving transistor DRT are increased.

In particular, since the voltage at the second node N2 of the driving transistor DRT was initialized to the reference voltage-for-sensing Vref, it starts to increase from the reference voltage-for-sensing Vref. At this time, an increase of the voltage at the second node N2 of the driving transistor DRT causes an increase of the voltage in the reference voltage line RVL, since the sensing transistor SENT is in the turned-on state.

In the sampling period SAMPLING, the initializing switch SW1 of the sensing circuit 134 of characteristic value is turned on when a predetermined time Δt has passed from a point in time at which the voltage at the second node N2 of the driving transistor DRT started to increase. At this time, the feedback capacitor Cfb is not charged before the initializing switch SW1 of the sensing circuit 134 of characteristic value is turned off, but the feedback capacitor Cfb of the sensing circuit 134 of characteristic value is charged from the capacitance of the storage capacitor Cst of the driving transistor DRT while the initializing switch SW1 of the sensing circuit 134 of characteristic value is turned off and the sampling switch SW2 is turned on.

At this time, the amplifier Amp of the sensing circuit 134 of characteristic value generates the sensing voltage Vsen according to the capacitance charged in the feedback capacitor Cfb. The sensing voltage Vsen may correspond to a voltage (Vref+ΔV) raised from the reference voltage-for-sensing Vref by a constant voltage ΔV. The mobility of the driving transistor DRT may be determined by using the measured sensing voltage (Vref+ΔV), reference voltage-for-sensing Vref, which is already known, and the passed time ΔT.

That is, the mobility of the driving transistor DRT is proportional to the voltage variation per unit time ΔV/Δt of the reference voltage line RVL through the tracking period TRACKING and the sampling period SAMPLING. Therefore, the mobility of the driving transistor DRT is proportional to the slope of the voltage in the reference voltage line RVL.

The compensator connected to the sensing circuit 134 of characteristic value compares the mobility determined with respect to the driving transistor DRT to the reference mobility or mobility of the other driving transistor DRT, and may compensate the deviation of the mobility among the driving transistors DRTs. Here, the compensation for the deviation of the mobility may be performed through a logic process or the like that multiplies the image data by the compensation value.

As described above, a period in which the characteristic values (threshold voltage and mobility) of the driving transistor DRT are sensed may be proceed after a power-on signal is generated and before the display driving starts. For example, when the power-on signal is applied to the display device 100, the controller 140 loads parameters necessary for driving the display panel 110 and then drives the display. In this case, the parameters required to drive the display panel 110 may include information on the sensing and compensation of characteristic values previously performed by the display panel 110, and the characteristics value (threshold voltage and mobility) of the driving transistor DRT during the parameter loading process may be sensed. As described above, a process in which the characteristic value is sensed during the parameter loading process after the power-on signal is generated is referred to as an on-sensing process.

Alternatively, a period in which the characteristic value of the driving transistor DRT is sensed may proceed after the power-off signal of the display device 100 is generated. For example, when the power-off signal is generated in the display device 100, the controller 140 may cut off the data voltage supplied to the display panel 110, and proceed the sensing process on the characteristic value of the driving transistor DRT during a predetermined time. In this way, the sensing process in which the characteristic value is sensed in a state in which the power-off signal is generated and the data voltage is cut off is referred to as an off-sensing process.

In addition, the sensing period for the characteristic value of the driving transistor DRT may proceed in real time while the display is being driven. This sensing process is referred to as a real-time sensing (RT sensing) process. In the case of the RT sensing process, the sensing process may be proceed on one or more sub-pixels SP in one or more sub-pixels SP lines for each blank period during the display driving period.

That is, during the display driving period in which an image is displayed on the display panel 110, the blank period in which the data voltage is not supplied to the subpixel SP may exist within one frame or between the nth frame and the n+1th frame, and in such the blank period, the mobility of one or more subpixels SP may also be sensed.

As described above, when the sensing process is proceed in the blank period, the subpixel SP line on which the sensing process is proceed may be randomly selected. Accordingly, abnormal phenomenon that may appear in the display driving period may be diminished after the sensing process in the blank period is processed. In addition, after the sensing process is proceed during the blank period, the recovery data voltage may be supplied to the subpixel SP on which the sensing process was proceed during the display driving period. Accordingly, abnormal phenomenon in the subpixel SP line for which the sensing process is completed in the display driving period after the sensing process in the blank period may be further alleviated.

At this time, since the threshold voltage sensing of the driving transistor DRT may take a long time for the voltage of the second node N2 of the driving transistor DRT to be saturated, the sensing and compensation the threshold voltage Vth is mainly proceed with the off-sensing process. On the other hand, since the mobility sensing of the driving transistor DRT takes a relatively short time compared to the threshold voltage sensing process, the mobility sensing and compensation may be proceed in the real-time sensing process.

Figure 7:
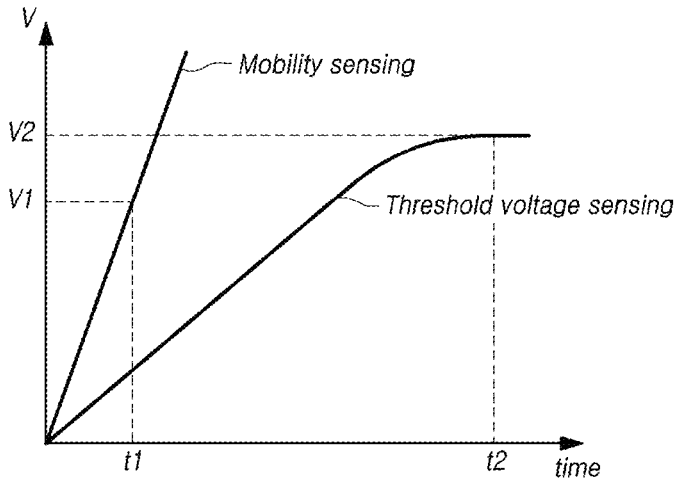
FIG. 7 is a threshold voltage sensing and mobility sensing graph of the driving transistor in the display device according to one or more embodiments.

FIG. 7 is a threshold voltage sensing and mobility sensing graph of the driving transistor in the display device according to one or more embodiments.

Referring to FIG. 7, in the display device 100 according to one or more embodiments, in order to sense the threshold voltage Vth of the driving transistor DRT, the voltage V2 of the reference voltage line RVL may be sensed after waiting for a second time t2 when the second node N2 of the driving transistor DRT is saturated. Accordingly, it takes at least a sensing time equal to or longer than the second time t2 for the second node N2 of the driving transistor DRT to saturate.

On the other hand, in order to sense the mobility of the driving transistor DRT, the voltage V1 of the reference voltage line RVL is sensed at a first time t1 near the point of time when the scan signal SCAN of the turn-off level is applied to the gate node of the switching transistor SWT without waiting for the second time t2 when the second node N2 of the driving transistor DRT is saturated. Accordingly, since the voltage fluctuation (ΔV/Δt) per unit time can be calculated, it is possible to sense its mobility for a short time.

Therefore, the display device 100 according to one or more embodiments can shorten the sensing and compensation time of the threshold voltage through current sensing two or more times in the mobility sensing period of the driving transistor DRT.

Figure 8:
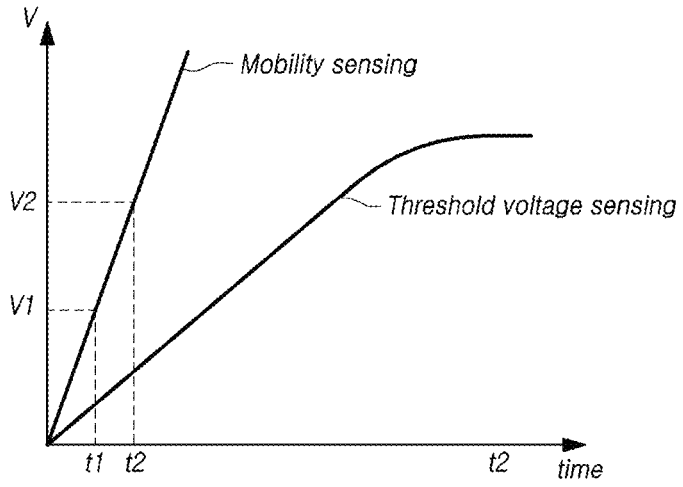
FIG. 8 is a graph illustrating a case in which sensing of driving currents is performed two or more times in a mobility sensing period of the driving transistor in the display device according to one or more embodiments.

FIG. 8 is a graph illustrating a case in which sensing of driving currents is performed two or more times in a mobility sensing period of the driving transistor in the display device according to one or more embodiments.

Referring to FIG. 8, the display device 100 according to one or more embodiments can calculate the threshold voltage Vth of the driving transistor DRT through two or more current sensing in the mobility sensing period of the driving transistor DRT.

As described above, the mobility sensing period of the driving transistor DRT may be comprised of the initializing period INITIAL, the tracking period TRACKING, and the sampling period SAMPLING.

Here, a period in which current sensing is proceed two or more times may correspond to the mobility sensing period of the driving transistor DRT. Accordingly, the driving current Ids flowing through the driving transistor DRT at the first time t1 and the second time t2 after the switching transistor SWT is turned off by the scan signal SCAN of the turn-off level is measured.

In this case, the driving current Ids flowing through the driving transistor DRT can be expressed as follows. Here, a represents the electron mobility of the driving transistor DRT, and Vs corresponds to the voltage of the source node.

$$Ids=\alpha*(V\text{data}-Vs-Vth)^2$$

At this time, in the tracking period TRACKING of the mobility sensing period, since the light emitting element OLED is turned on, Vs becomes 0 when the base voltage EVSS is the ground voltage. Accordingly, the driving current Ids of the driving transistor DRT can be expressed as follows.

$$Ids=\alpha*(V\text{data}-Vth)^2$$

Meanwhile, since the sensing transistor SENT is turned on in the tracking period during the mobility sensing period, the driving current Ids of the driving transistor DRT and the current Iref flowing through the reference voltage line RVL becomes the same.

In this case, the current Iref flowing through the reference voltage line RVL may be expressed as follows.

$$Iref = C * \frac{\Delta V}{\Delta t}$$

Here, Δt is a time interval for measuring the current Iref of the reference voltage line RVL after the switching transistor SWT is turned off by the scan signal SCAN of the turn-off level, and ΔV represents the amount of change in the voltage of the reference voltage line RVL during the time interval of Δt. At this time, when the current Iref is measured by the characteristic value sensing circuit 134, C corresponds to the capacitance value of the feedback capacitor Cfb.

Therefore, ΔV1 corresponds to the sensing voltage Vsen charged in the sensing circuit 134 of characteristic value during the first time interval Δt1 set based on the first time t1, and ΔV2 is. It corresponds to the sensing voltage Vsen charged in the sensing circuit 134 of characteristic value during the second time interval Δt2 set based on the second time t2.

At this time, the first time interval Δt1 and the second time interval Δt2 are arbitrary time intervals set from the first time t1 and the second time t2, respectively, and may be variously selected within a period in which the voltage of the reference voltage line RVL increases, in the mobility sensing process of the driving transistor DRT.

Since the driving current Ids of the driving transistor DRT and the current Iref flowing through the reference voltage line RVL are the same, the driving current Ids flowing through the driving transistor DRT and the current Iref flowing through the reference voltage line RVL at (t2) at the first time t1 and the second time t2 in the tracking period of the mobility sensing period can be expressed as follows.

$$Ids1 = C * \frac{\Delta V1}{\Delta t1} = \alpha * (\text{Vdata1} - \text{V}th)^2$$

$$Ids2 = C * \frac{\Delta V2}{\Delta t2} = \alpha * (\text{Vdata2} - \text{V}th)^2$$

Dividing the above two expressions becomes as follows.

$$Ids1 / Ids2 = \left(C * \frac{\Delta V1}{\Delta t1}\right) \Big/ \left(C * \frac{\Delta V2}{\Delta t2}\right) = [\alpha * (\text{Vdata1} - \text{V}th)^2] / [\alpha * (\text{Vdata2} - \text{V}th)^2]$$

At this time, since the capacitance C of the feedback capacitor Cfb and the electron mobility a of the driving transistor DRT are the same, it can be expressed again as follows.

$$Ids1 / Ids2 = \left(\frac{\Delta V1}{\Delta t1}\right) \Big/ \left(\frac{\Delta V2}{\Delta t2}\right) = [(\text{Vdata1} - \text{V}th)^2] / [(\text{Vdata2} - \text{V}th)^2]$$

Here, when the first time interval Δt1 and the second time interval Δt2 for sensing the sensing voltage Vsen charged in the sensing circuit 134 of characteristic value is set equally, the threshold voltage Vth of the driving transistor DRT can be expressed as follows.

$$Vth = \frac{Vdata1 - Vdata2 * \sqrt{\frac{\Delta V1}{\Delta V2}}}{1 - \sqrt{\frac{\Delta V1}{\Delta V2}}}$$

That is, when the first time interval Δt1 and the second time interval Δt2 for measuring the driving current Ids of the driving transistor DRT in the tracking or sampling periods of the mobility sensing period of the driving transistor DRT is set equally, and the data voltages Vdata1 and Vdata2 applied to the driving transistor DRT at the first time t1 and the second time t2 are set to a predetermined value, the amount of change in the sensing voltage Vsen is measured by the sensing circuit 134 of characteristic value during the 1 time interval Δt1 and the second time interval Δt2, the threshold voltage Vth of the driving transistor DRT is calculated from this.

As a result, the display device 100 does not need to wait until the second node N2 of the driving transistor DRT is saturated, and the threshold voltage Vth of the driving transistor DRT can be sensed and compensated for in a short time through sensing the driving current Ids two or more times from the point when the scan signal SCAN of the turn-off level is applied to the gate node of the switching transistor SWT.

Accordingly, the display device 100 may perform not only the mobility sensing process of the driving transistor DRT but also the threshold voltage Vth sensing process in a short time such as a blank period during the display driving period. Accordingly, by performing the mobility sensing and threshold voltage Vth sensing processes in the blank period, it is possible to diminish an abnormal phenomenon that may occur in the display driving period.

In this case, the sensing of the driving current Ids two or more times may be performed in one blank period, or may be performed once in each of different blank periods.

Figure 9:
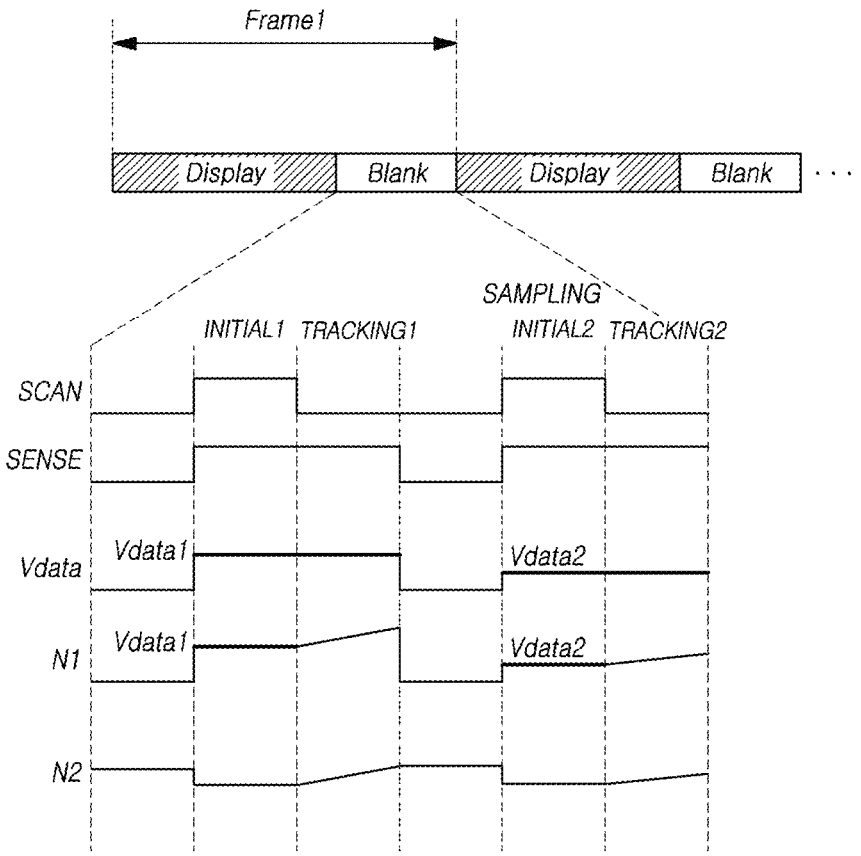
FIG. 9 illustrates a signal flow diagram when sensing of driving currents is performed two or more times in one blank period in the display device according to one or more embodiments.

FIG. 9 illustrates a signal flow diagram when sensing of driving currents is performed two or more times in one blank period in the display device according to one or more embodiments.

Referring to FIG. 9, the display device 100 according to one or more embodiments includes, within one frame, a display period Display in which a plurality of subpixels SP emits light and a blank period Blank in which they do not emit light.

Accordingly, during the display period Display, the data voltage Vdata for displaying the image is supplied to the subpixel SP, but during the blank period Blank the data voltage Vdata may not be applied or a black data voltage may be supplied to the subpixel SP.

During this blank period Blank, the driving current flowing through the driving transistor DRT is measured at the same time interval at two or more different times t1 and t2 in the period when the mobility sensing process is proceed to sense the mobility of the driving transistor DRT but the switching transistor SWT is turned on by the scan signal SCAN of the turn-off level.

As described above, the threshold voltage Vth of the driving transistor DRT can be calculated by using the driving currents Ids1 and Ids2 of the driving transistor DRT measured at the different times t1 and t2 in one blank period.

As shown in FIG. 9, in order to measure the mobility of the driving transistor DRT in the blank period, the driving current Ids1 is measured at a first time t1 through a first initializing g period INITIAL1 and a first tracking period TRACKING1 and then the driving current Ids2 is measured at the second time t2 through the second initializing period INITIAL2 and the second tracking period TRACKING2.

Figure 10:
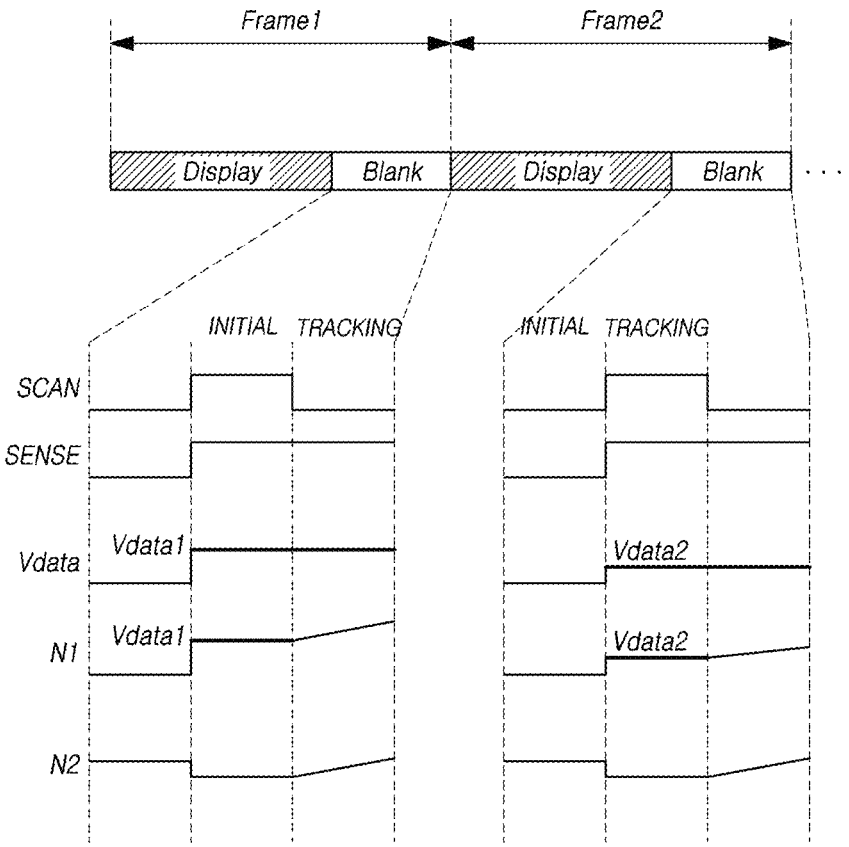
FIG. 10 illustrates a signal flow diagram when sensing of driving currents is performed in different blank periods in the display device according to one or more embodiments.

FIG. 10 illustrates a signal flow diagram when sensing of driving currents is performed in different blank periods in the display device according to one or more embodiments.

Referring to FIG. 10, the display device 100 according to one or more embodiments can perform the mobility sensing process for sensing the mobility of the driving transistor DRT during different blank periods.

That is, during the blank period Blank of the first frame Frame1, the driving current Ids1 flowing through the driving transistor DRT may be measured at one time interval Δt1 at the first time t1in the period when the switching transistor SWT is turned off by the scan signal SCAN of the turn-off level. In addition, during the blank period Blank of the second frame Frame2, the driving current Ids2 flowing through the driving transistor DRT may be measured at a time interval Δt2 equal to the first time interval Δt1 at the second time t2 in the period when the switching transistor SWT is turned off.

As described above, the threshold voltage Vth of the driving transistor DRT may be calculated by using the first driving current Ids1 of the driving transistor DRT measured at the first time t1 within one blank period Blank and the second driving current Ids2 of the driving transistor DRT measured at the second time t2 in a different blank period Blank.

Figure 11:
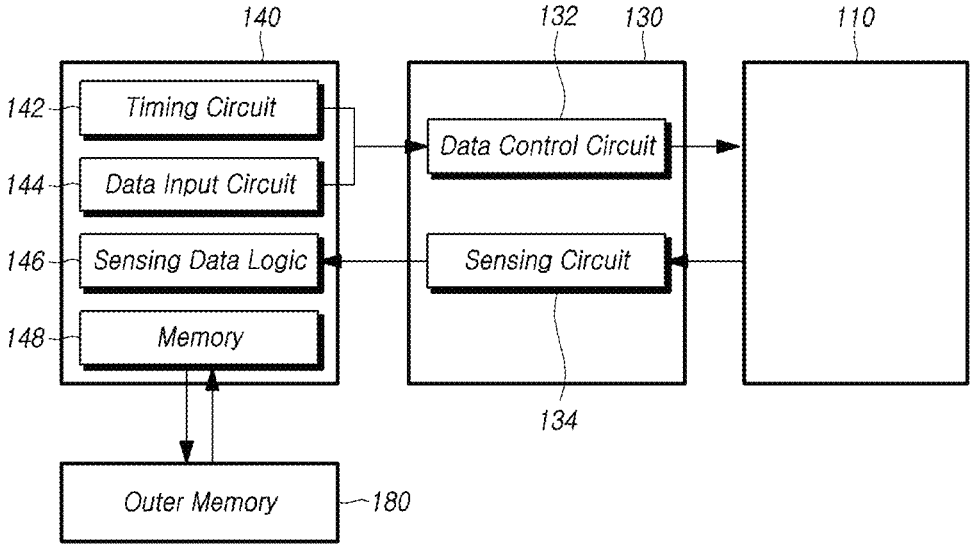
FIG. 11 schematically illustrates a system configuration for calculating a threshold voltage through sensing of driving currents two or more times in a mobility sensing period of the driving transistor in the display device according to one or more embodiments.

FIG. 11 schematically illustrates a system configuration for calculating a threshold voltage through sensing of driving currents two or more times in a mobility sensing period of the driving transistor in the display device according to one or more embodiments.

Referring to FIG. 11, in the display device 100 according to one or more embodiments includes a display panel 110 in which a plurality of gate lines GL and a plurality of data lines DL are connected, and a plurality of subpixels SP are aligned in a matrix form, a gate driving circuit 120 driving the plurality of the gate lines GL, a data driving circuit 130 supplying a data voltage through the plurality of the data lines DL, a controller 140 that controls the gate driving circuit 120 and the data driving circuit 130, and an outer memory 180.

The controller 140 may include a timing circuit 142, a data input circuit 144, a sensing data logic 146, and an memory 148.

In order to measure the mobility of the driving transistor DRT, the timing circuit 142 serves to control a first time t1 for measuring the first driving current Ids1 of the driving transistor DRT, a second time t2 for measuring the second driving current Ids2 of the driving transistor DRT, and a first time interval Δt1 and a second time interval Δt2.

The data input circuit 144 serves to transfer the digital image data DATA to the data driving circuit 130 so that a first data voltage Vdata1 and a second data voltage Vdata2 is applied to the display panel 110 according to the first time t1 and the second time t2 set by the timing circuit 142.

The sensing data logic 146 calculates the threshold voltage Vth or the mobility of the driving transistor DRT based on the sensing voltage Vsen transmitted from the sensing circuit 134 of the characteristic value of the data driving circuit 130.

In this case, the calculation result may be stored in the memory 148 of the controller 140, and the deviation of the characteristic value can be compensated. by comparing the reference threshold voltage or the reference mobility stored in the outer memory 180 with it.

The data driving circuit 130 may include a data control circuit 132 and a sensing circuit 134 of characteristic value.

According to the control of the controller 140, the data control circuit 132 applies the first data voltage Vdata1 and the second data voltage Vdata2 to the display panel 110 according to the first time t1 and the second time t2.

The sensing circuit 134 of characteristic value controls to sense the voltage of the second node N2 and the reference voltage line RVL of the driving transistor DRT during the first time interval Δt1 and the second time interval Δt2 and provide the controller 140 with the sensing voltage Vsen.

As described above, the display device 100 according to one or more embodiments may sense and compensate the threshold voltage Vth of the driving transistor DRT in a short time through sensing the driving current Ids two or more times from the point when the scan signal SCAN of the turn-off level is applied to the gate node of the switching transistor SWT.

It will be apparent to those skilled in the art that various modifications and variations can be made in the present disclosure without departing from the technical idea or scope of the disclosure. Thus, it is intended that the present disclosure cover the modifications and variations of this disclosure provided they come within the scope of the appended claims and their equivalents.

The invention claimed is:

1. A display device, comprising:

a display panel including a plurality of gate lines, a plurality of data lines, and a plurality of subpixels;

a gate driving circuit for driving the plurality of gate lines; and a data driving circuit for driving the plurality of data lines and generating sensing voltages measured at different times during a blank period in a mobility sensing period of a driving transistor performed in real time on a display driving operation, wherein the threshold voltage of the driving transistor is calculated by the following expression, $$Vth = \frac{Vdata1 - Vdata2 * \sqrt{\frac{\Delta V1}{\Delta V2}}}{1 - \sqrt{\frac{\Delta V1}{\Delta V2}}}$$

wherein Vdata1 is the data voltage applied at the first time, Vdata2 is the data voltage applied at the second time, and ΔV1 and ΔV2 are sensing voltages charged by a sensing circuit of characteristic value at the same time interval at the first time and the second time, respectively.

2. The display device according to claim 1, further comprising a controller for controlling the gate driving circuit and the data driving circuit, and calculating a threshold voltage of the driving transistor from the sensing voltage transmitted from the data driving circuit.

3. The display device according to claim 1, wherein each of the plurality of subpixels comprises:

an organic light-emitting diode driven by the driving transistor;

a switching transistor electrically connected between a gate node of the driving transistor and a data line among the plurality of data lines;

a sensing transistor electrically connected between either a source node or a drain node of the driving transistor and a reference voltage line; and a storage capacitor electrically connected between the gate node of driving transistor and either a source node or a drain node of the switching transistor.

4. The display device according to claim 3, wherein the data driving circuit comprises the sensing circuit of characteristic value for sensing a characteristic value of the driving transistor.

5. The display device according to claim 4, wherein the sensing circuit of characteristic value comprises:

an amplifier having an inverting input terminal electrically connected to the reference voltage line connected to either a source node or a drain node of the sensing transistor and a non-inverting input terminal supplied with a reference voltage-for-comparing;

a feedback capacitor electrically connected between the inverting input terminal and an output terminal of the amplifier;

an initializing switch electrically connected to the feedback capacitor; and a sampling switch electrically connected to the output terminal of the amplifier.

6. The display device according to claim 1, wherein the mobility sensing period of the driving transistor comprises:

an initializing period in which a data voltage-for-sensing is supplied to the subpixel to be sensed through the data line, and a reference voltage-for-sensing is supplied to the subpixel to be sensed through a reference voltage line;

a tracking period in which the reference voltage-for-sensing is blocked by turning off the switching transistor and a voltage of the reference voltage line is increased; and a sampling period in which a current flowing through the reference voltage line is sensed.

7. The display device according to claim 1, wherein the sensing voltages are voltages respectively measured in different blank periods.

8. A method of sensing a characteristic value of a circuit element in a display device, the method comprising:

supplying a data voltage-for-sensing to a subpixel to be sensed through a data line, and supplying a reference voltage-for-sensing to the subpixel to be sensed through the reference voltage line;

blocking the reference voltage-for-sensing and increasing a voltage of the reference voltage line in response to the reference voltage-for-sensing being blocked;

sensing a driving current through the reference voltage line at different times; and calculating a threshold voltage of a driving transistor from a sensing voltage generated by the driving current, wherein the threshold voltage of the driving transistor is calculated by the following expression, $$Vth = \frac{Vdata1 - Vdata2 * \sqrt{\frac{\Delta V1}{\Delta V2}}}{1 - \sqrt{\frac{\Delta V1}{\Delta V2}}}$$

wherein Vdata1 is the data voltage applied at the first time, Vdata2 is the data voltage applied at the second time, and AV1 and AV2 are sensing voltages charged by a sensing circuit of characteristic value at the same time interval at the first time and the second time, respectively.

9. The method according to claim 8, wherein the sensing the driving current is proceed during a mobility sensing period of the driving transistor.

10. The method according to claim 9, wherein the mobility sensing period is performed in real time while a display panel is being driven.

11. The method according to claim 10, wherein the sensing voltages are voltages measured at different times in one blank period.

12. The method according to claim 8, wherein the sensing voltages are voltages respectively measured in different blank periods.

* * * * *